US009587829B1

(12) United States Patent
Deng et al.

(10) Patent No.: US 9,587,829 B1
(45) Date of Patent: Mar. 7, 2017

(54) PRE-START INDICATOR FOR PORTABLE HEATER

(71) Applicant: Procom Heating, Inc., Brea, CA (US)

(72) Inventors: David Deng, Diamond Bar, CA (US); Joseph B. Lee, Jr., Bowling Green, KY (US)

(73) Assignee: PROCOM HEATING, INC., Brea, CA (US)

( * ) Notice: Subject to any disclaimer, the term of this patent is extended or adjusted under 35 U.S.C. 154(b) by 594 days.

(21) Appl. No.: 13/964,753

(22) Filed: Aug. 12, 2013

(51) Int. Cl.
*F23N 5/24* (2006.01)
*F23N 5/00* (2006.01)

(52) U.S. Cl.
CPC ..... *F23N 5/00* (2013.01)

(58) Field of Classification Search
USPC ..... 431/13, 14; 126/110 B, 110 C, 110 D
See application file for complete search history.

(56) References Cited

U.S. PATENT DOCUMENTS

| | | | | |
|---|---|---|---|---|
| 3,182,653 | A | 5/1965 | Mavleos et al. | |
| 3,631,447 | A | 12/1971 | Sulat et al. | |
| 4,110,742 | A | 8/1978 | Hawkins | |
| 4,145,179 | A * | 3/1979 | Tanaka | F23N 5/203 431/14 |
| 4,266,221 | A | 5/1981 | Hawkins | |
| 4,270,800 | A * | 6/1981 | Barry | E21C 35/04 173/3 |
| 4,344,647 | A * | 8/1982 | Van Der Linden | E05B 65/108 292/201 |
| 4,649,288 | A * | 3/1987 | Barry | E21F 9/00 299/1.05 |
| 5,165,107 | A | 11/1992 | Hand et al. | |
| 5,189,388 | A | 2/1993 | Mosley et al. | |
| 5,264,834 | A | 11/1993 | Silken et al. | |
| 5,574,437 | A | 11/1996 | Schwinn et al. | |
| 6,152,128 | A * | 11/2000 | Willey | F24H 3/0488 126/110 B |
| 7,482,942 | B2 | 1/2009 | Kajander et al. | |
| 2003/0012563 | A1 | 1/2003 | Neugebauer et al. | |
| 2003/0020619 | A1 | 1/2003 | Winters et al. | |
| 2006/0275719 | A1 | 12/2006 | Hill et al. | |
| 2008/0048840 | A1 | 2/2008 | Reagan et al. | |
| 2010/0106316 | A1 | 4/2010 | Curry et al. | |
| 2010/0106318 | A1 | 4/2010 | Grohman et al. | |
| 2010/0106809 | A1 | 4/2010 | Grohman | |
| 2011/0126820 | A1 | 6/2011 | Barkhouse et al. | |
| 2012/0048263 | A1 | 3/2012 | Johnson | |
| 2012/0094244 | A1 | 4/2012 | Vandrak | |

FOREIGN PATENT DOCUMENTS

| | | |
|---|---|---|
| GB | 2106681 | 4/1983 |

* cited by examiner

*Primary Examiner* — Avinash Savani
(74) *Attorney, Agent, or Firm* — Middleton Reutlinger

(57) ABSTRACT

A portable heater provided with one or more pre-start indicator elements. The pre-start indicator element may emit an attention identifier indicative of the imminent start of heat production of the portable heater. The indicator element may be an audible and/or visual indicator element. The pre-start indicator element may alert during one or both of a manual and thermostat operation mode of a portable heater.

8 Claims, 4 Drawing Sheets

PRE-START INDICATOR FOR PORTABLE HEATER

TECHNICAL FIELD

The present invention relates to portable heating units in particular to a portable heating unit with pre-start indicator.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
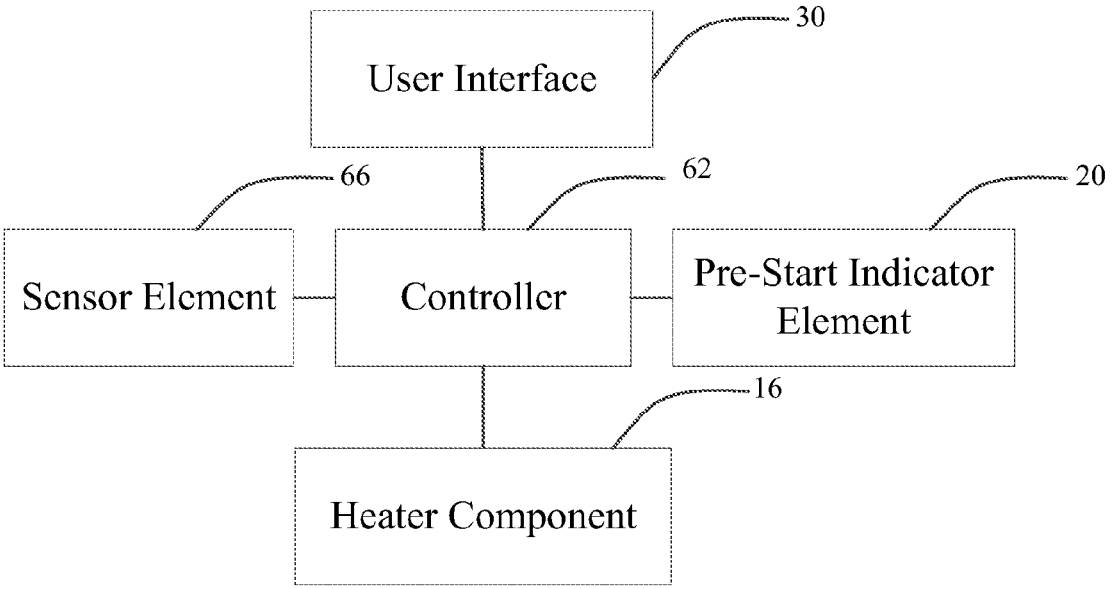
FIG. 1 is a diagram of an example environment in which a pre-start indicator for a portable forced air heater may be implemented.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

The term "controller" is used herein generally to describe various apparatus relating to the operation of one or more heater components and indicator elements. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

Furthermore, and as described in subsequent paragraphs, the specific mechanical or electrical configurations illustrated in the drawings are intended to exemplify embodiments of the invention and that other alternative electrical and mechanical configurations are possible.

The portable forced air heating unit 10 depicted in the figures provides for an alarm, warning, or pre-start indicator element 20 that includes, but is not limited to, an audible and/or visual indicator or alarm, 24 and 22 respectively, occurring for a predetermined time period to give an alert or warning of imminent heater startup or heat production. The indicator element 20 emits an attention identifier sufficient to call attention to the operator and any bystanders while in a variety of heater environments and portable heater modes. The attention identifier may be, but is not limited to, visual, audio, vibratory, combinations thereof, or other sensory emissions. The predetermined time period and/or the pre-start indicator element 20 may allow those in close proximity to the portable heater to reposition themselves relative to the heater, move materials or devices away from the heated airflow, or make changes to the heater operation, such as but not limited to, repositioning the heater, stopping the operation of the heater, changing between modes such as manual or thermostat, or making input adjustments indirectly or directly.

Portable forced air heaters conventionally include a housing, a burner head assembly mounted within the housing, and an air blower system within the housing behind the burner head assembly. Fuel (kerosene, fuel oil, or diesel fuel, etc.) is conveyed to the burner head assembly and combustion chamber. The blower supplies combustion air to the burner head assembly and forces hot combustion gases from the burner head assembly while cooling the exterior of the burner head assembly and combustion chamber. Although a kerosene forced air heater is shown in detail it is understood that the embodiments of the invention may be used in any type of portable forced air heater such as, but not limited to, a gas or multi-fuel forced air heater.

As shown in FIGS. 1-4, there is one embodiment of a portable forced air heating unit 10 within which one or more pre-start indicator elements 20 are utilized. Unit 10 includes a fuel tank assembly 70, an elongated housing 50 superposed upon the fuel tank assembly 70, and a controls compartment 60 disposed between so as to join the housing 50 to fuel tank assembly 70. Housing 50 includes a combustion chamber assembly 40, described herein, within which a mixture of fuel and air is burned, and the fuel tank assembly 70 contains a reservoir or tank 74 of fuel for burning within the combustion chamber. Routed through controls compartment 60 between fuel tank assembly 70 and housing 50 is a fuel line 81 and air line 82 and appropriate controller 62 associated with the housing 50 and fuel tank assembly 70 for controlling the heater operation. The electronic controller 62 is provided that can comprise in whole or part, but is not limited to, digital logic, a programmable logic device, a programmed microprocessor, and other logic. In some preferred embodiments controller 62 is a programmed microprocessor and has a memory that may be integral with controller 62, or may be separate from, but in communication with, controller 62. It should also be understood that the controls compartment 60 and controller 62 may be located or mounted in any number of positions and be a variety of dimensions, shapes, quantities, and construction.

Figure 3:
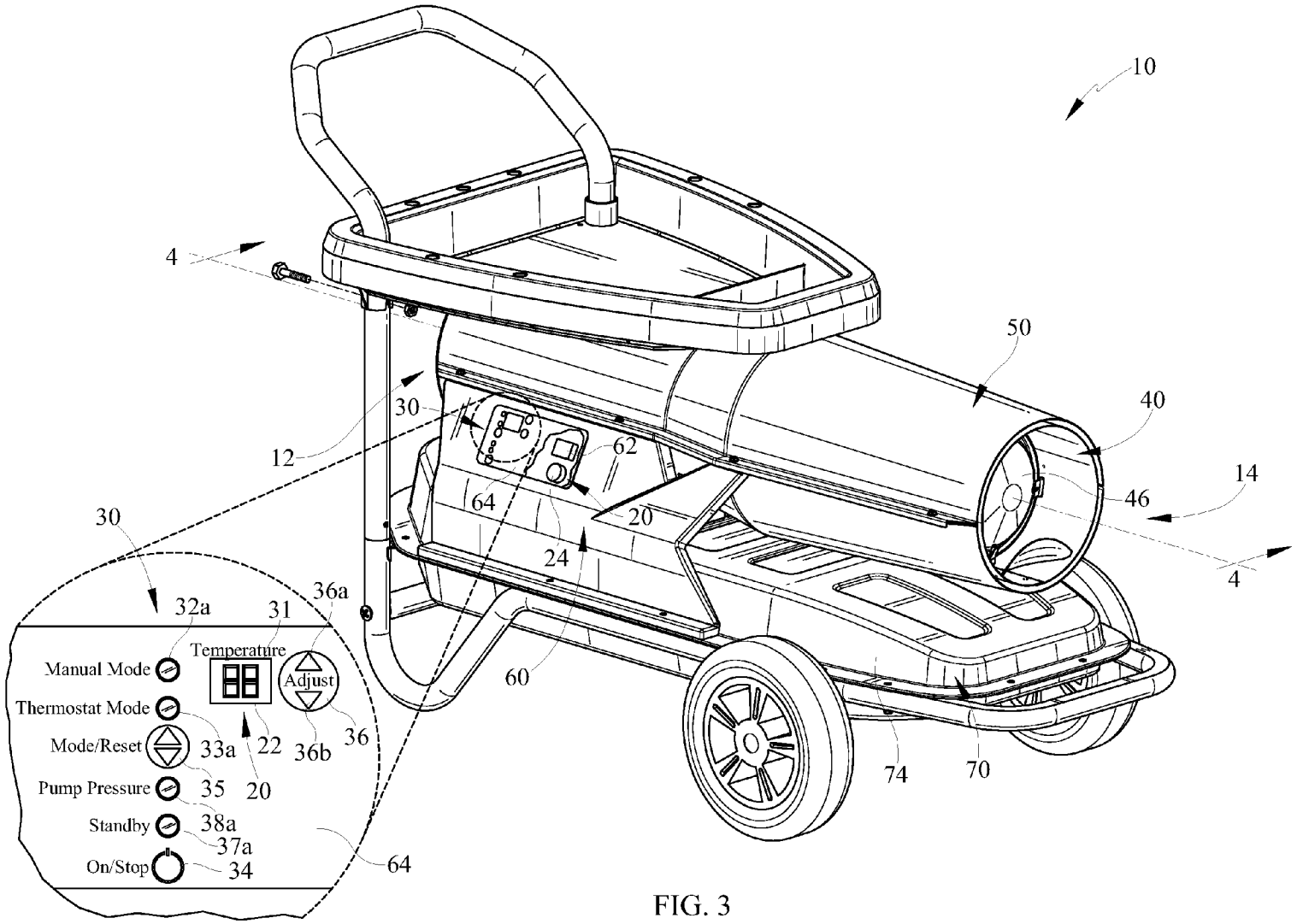
FIG. 3 is a perspective view of a portable forced air heater according to one embodiment with portions of the control panel broken away.
Figure 4:
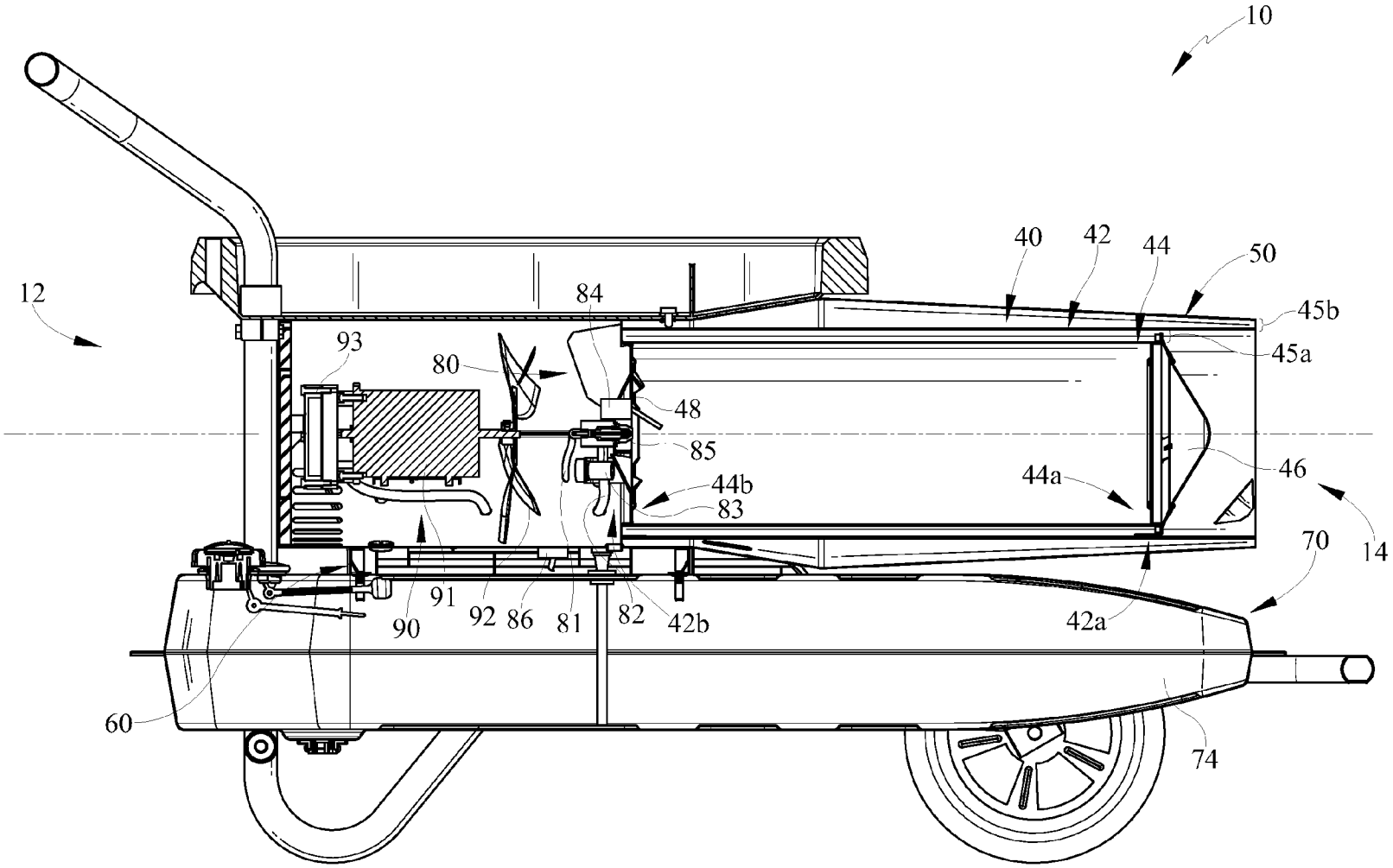
FIG. 4 is a sectional view of the portable forced air heater of FIG. 3 taken along line 4-4.

Elongated housing 50 is generally cylindrical and may support a combustion chamber assembly 40, best shown in FIGS. 3 and 4. Housing 50 and/or combustion chamber assembly 40 may be a variety of different shapes, sizes, configurations, constructions, and still be within the scope of the embodiments. Combustion chamber assembly 40 may include a cylindrical outer shell or heat shield 42 and/or a cylindrical inner shell or combustion chamber 44 therewithin. Combustion chamber 44 is arranged substantially centrally of heat shield 42 so that a radial or annular spacing 45*a* exists between combustion chamber 44 and heat shield 42 and/or housing 50. Heat shield 42 has two opposing ends 42*a* and 42*b*, and combustion chamber 44 has two opposing ends 44*a* and 44*b* corresponding with heat shield ends 42*a*, 42*b*, respectively. One end or inlet end 44*b* of the combustion chamber 44 is covered by a burner head assembly 80, and the opposing end or outlet end 44*a* of combustion chamber 44 is covered by the afterburner 46. Combustion chamber assembly 40 is supported within housing 50 by, for example, brackets joined between housing 50 and heat shield 42 so that a radial or annular spacing 45*b* exists between the housing and the heat shield. It is understood that the airflow cooling channel, spacing, or gaps to allow airflow between the housing and heat shield, combustion chamber, or combustion chamber assembly may be a variety of sizes, shapes, dimensions radially or longitudinally, orientations, and constructions and still be within the scope of the embodiments.

During operation of heating unit 10, air is drawn from the surrounding environment through inlet end 12 of housing 50, heated, and then forced out of outlet end 14 to heat the surrounding environment. Burner head assembly 80 includes an air line 82 in fluid communication with the motor and pump assembly 90. Motor 91 drives a fan 92 to draw air from the back of the unit or inlet end 12 in order to circulate or push air into and around a combustion chamber assembly. When pushed air circulates around the combustion chamber assembly through the annular spacing 45*a*, 45*b* the housing wall 50 is cooled. Air may be circulated through a rear plate 48 when entering combustion chamber assembly 40. A mixture of fuel and air is routed into a nozzle 85 adjacent the combustion chamber 44 through burner head assembly 80 where it is burned in a combustion process via an igniter 84. The fuel may be delivered to the combustion chamber 44 through fuel line 82 in the form of oil droplets formed by an atomizing process. Regardless of the atomizing process, however, incomplete combustion may occur within the combustion chamber 44 due to non-uniformity in size of the fuel droplets or an uneven mixing of the fuel droplets with air. Combustion chamber outlet end 44*a* provides the discharge end for combustion chamber 44, and the afterburner 46 is positioned adjacent the outlet end 44*a* of the chamber 44 for burning fuel particles which are not burned within the combustion chamber 44 to reduce the likelihood that unburned fuel particles will be discharged from heater 10 and enter the surrounding environment. The air is heated and provides a stream of clean, hot air out of the exit or outlet end 14 of unit 10. Air circulated between the combustion chamber assembly 40 and housing 50 cools the burner head assembly 80, combustion chamber assembly 40, and housing 50.

Figure 2:
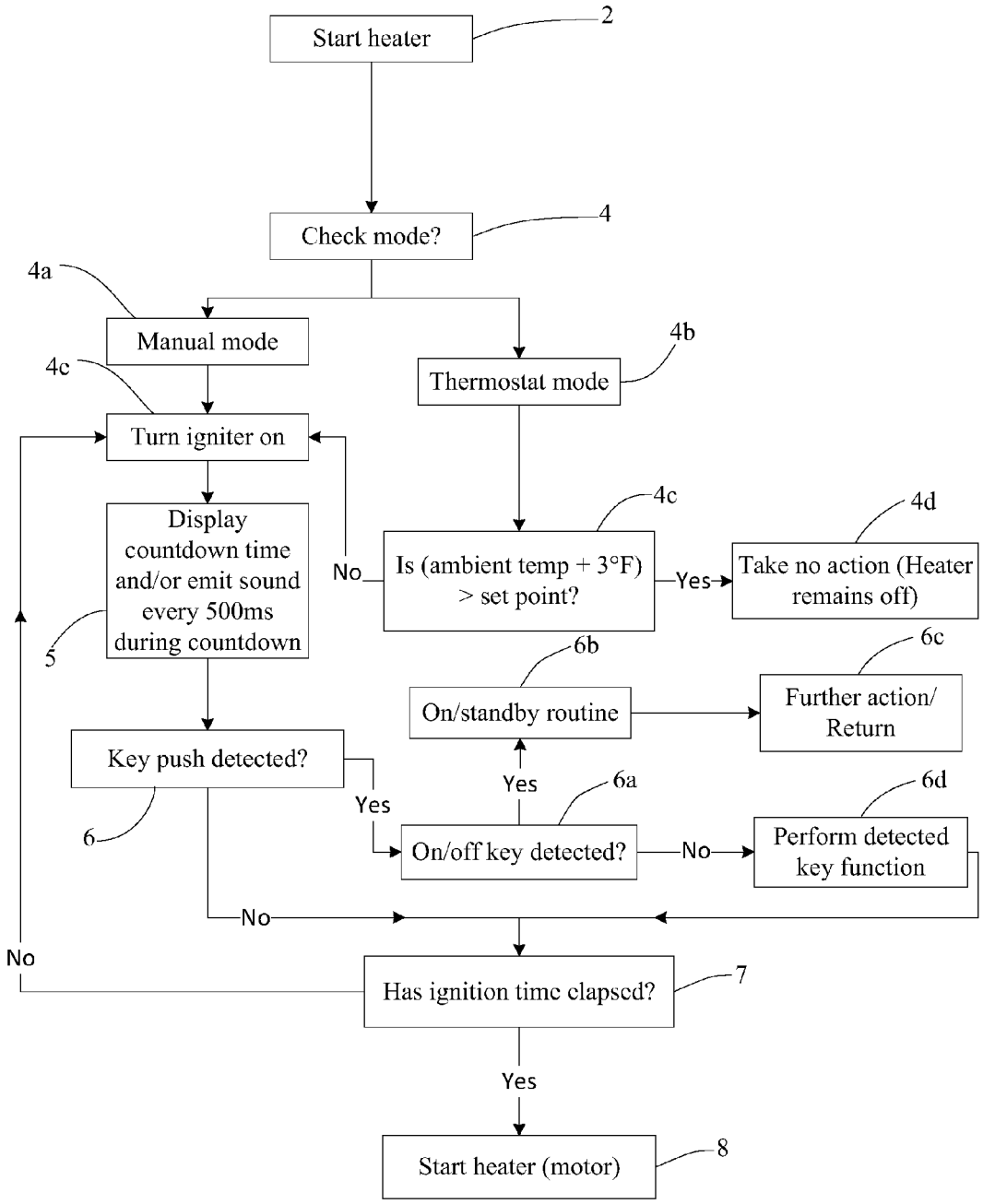
FIG. 2 is flow chart of an embodiment of a method of alerting of an imminent start of heat production according to an embodiment of a portable forced air heater.

As shown in FIGS. 1-4, the one or more pre-start indicator elements 20 may create one or more outputs or alerts, such as the attention identifiers, to the external environment or to users in the vicinity of the portable heater 10 of imminent heater startup or heat production. The indicator elements 20 may be, but are not limited to, a visual indicator 22, an audible indicator 24, or combinations thereof. Further the control compartment 60 may include one or more indicator elements 20. For instance one embodiment of the visual indicator 22 may be an optical emitter or more specifically a visual display 31, such as a LED, to visually indicate the imminent start of the heater 10, more specifically a numerical countdown for a predetermined time period before heat production. Although the attention identifier may be a numerical countdown as shown, it merely represents one embodiment, and it is to be understood that the visual indicator 22 may be of a variety of visual attention identifiers or alerting methods, quantities, constructions, shapes, and positions relative to the portable heater and still be sufficient to call attention to the imminent startup or heat production of the heater. For example but not limited to, the attention identifier may emit a pattern such as a flashing light, a continuous illumination, a variety of colors, shapes, or illustrations, increasing or decreasing the frequency of emitted light, or combinations thereof. Another indicator element 20 may be the audible indicator 24. One embodiment of the audible indicator 24 may be an audible or audio alarm emanating one or more sounds or attention identifiers from the control panel 64 or control compartment 60 via one or more speakers or devices as shown. The audible indicator 24 may be a variety of outputs or attention identifier emissions such as a pattern of beeping sounds. Although the attention identifier may be a pattern of sounds, it merely represents one embodiment, and it is to be understood that there are a variety of quantities, constructions, and a variety of positions relative to the heater to emit from, and still be sufficient to call attention to the imminent startup or heat production of the heater. For example but not limited to, the attention identifier may emit an audible sound having a variety of durations or intervals, verbal warnings, and a range of volumes. Further, one example of the pre-start indicator element 20 may utilize both the audible indicator 24 and visual indicator 22 as shown in FIG. 2 that includes a display 31 of a numerical countdown for a predetermined time period of eight seconds while also emitting a sound or beep every 500 ms. It should also be understood that the attention identifiers or output of the audible and visual indicator elements need not overlap in duration, may partially overlap in duration, and may each extend for a variety of different or similar predetermined time periods. Alternatively, the time period may be determined by a number of factors or variables. As such, although one or more pre-start indicator elements 20 is shown in detail in the drawings, it merely represents one embodiment, and it is to be understood that there are a variety of shapes, dimensions, quantities, positions relative to the housing or unit, compositions, and constructions which may be used and still be within the scope of these embodiments.

The pre-start indicator elements 20 will emit the attention identifier to alert the operator and/or bystanders in the vicinity of the heater 10 in each one of the manual mode 32 and thermostat mode 33. It is understood that an embodiment of the portable heater 10 may have one or both of the manual and thermostat modes 32 and 33 and still include one or more pre-start indicator elements 20. While in the manual mode 32, the portable heater's heat production or heated airflow output will be preceded by the output or alert of one or more indicator elements 20. For instance in use, once the heater 10 is turned on and in the manual mode 32, the indicator element 20 will sound and/or display for the predetermined time period before ignition. Further while in thermostat mode 33, the portable heater's heat production or output will be preceded by the one or more indicator elements 20 when the ambient value is less than the user set point input. Alternatively, if the ambient value is greater than the user set point input, the igniter 84 and heater is turned off and the predetermined time period of the indicator element may not occur until the subsequent temperature condition for startup is met. As a result, a portable heater 10 equipped with a thermostat while in the thermostat mode 33 may startup at various times and the one or more indicator elements 20 may advantageously alert or warn bystanders via the attention identifier in each occurrence that there is an imminent or automatic heater startup.

A depicted in FIG. 1, controller 62 is preferably in electrical communication with one or more sensor elements 66, one or more user interfaces 30, and one or more heater components 16. The control compartment 60 may include a control panel 64 having one or more user interfaces 30 therein. Controller 62 receives one or more inputs indicative of the values or signals of the sensor elements 66, user interfaces 30, and other heater components 16 to determine when to operate the indicator elements 20 for the predetermined time period before ignition. Heater components 16 may include, but are not limited to, the igniter 84, fan 92, motor 91, fuel solenoid valve 86, thermocouple (not shown), and compressor 93. Similarly, controller 62 may output to or transmit a signal to one or more of the heater components, sensor elements, and user interfaces. For example, controller 62 could cause igniter 84 to only be energized during the ignition cycle, and only reenergized should an event occur that warrants ignition, such as upon loss of combustion, during heater shutdown, or intermittently during heater operation to burn off any carbon deposits that may develop. Another example, controller 62 could selectively operate the fuel solenoid valve 86 to either allow or prevent fuel from passing from fuel tank 74 to nozzle 85. Sensor element 66 includes at least one sensor and may include a plurality of sensors. By way of example only, several of the sensors that could form, in whole or in part, sensor element 66, will be described. User interface 30 includes at least one interface or input and may include a plurality of interfaces. By way of example only, several of the interfaces that could form, in whole or in part, user interface 30, will be described. Also, by way of example only, description may be provided outlining one or more exemplary ways controller 62 receives input indicative of values or signals from a particular sensor element 66, user interface 30, and/or heater component 16.

One such sensor element that could comprise sensor element 66, in whole or in part, is a thermostat. The thermostat may have an appropriate location to obtain the data or ambient temperature. The temperature obtained by the thermostat is used by the controller 62, among other things, to compare to the set point temperature to obtain the desired temperature of the surrounding environment of the portable heater.

Another sensor element 66 could be a photo sensor 83 such as a fast photocell, a light sensitive resistor, or a fiber optic cable connected to a phototransistor, photoresistor, or photodiode. An example of such a photo sensor 83 is shown most clearly in FIG. 4. Such a photo sensor 83 would have a view of the combustion process in combustion chamber 44 of heater 10 through an opening in combustion chamber 44, or other appropriate location. The data obtained by photo sensor 83 could be used by controller 62 to monitor, among other things, flame quality, flame turbulence, flame intensity, and flame color. Controller 62 could utilize the photo sensor data for a number of purposes, including monitoring combustion, verifying integrity of fan 92, obtaining an indirect indication of the fuel level of fuel tank 74, and controlling igniter 84.

Another sensor element 66 could be a line voltage sensor such as a voltage divider monitored by controller 62. If the voltage monitored by controller 62 is too high or too low, controller 62 may remove power or prevent power from being applied to igniter 84 to prevent damage to the components and a message or a code indicating high voltage may be displayed visually or audibly.

Other sensors that may form part of sensor element 66 may include a carbon monoxide sensor or carbon dioxide sensor incorporated to monitor air quality and programmable timers to turn the heater on or off. Again, the entirety of the sensors described and their placement in the forced air heater 10 are merely exemplary of the multitude of sensors that could be placed in a multitude of places and could form in whole or in part sensor element 66. Additionally, the controller 62 may utilize data from any given sensor or heater component in a plurality of ways to operate the heater unit 10.

Controller 62 could also execute instructions to effectuate a delay lockout period to prevent rapid on and off cycling of heater 10 or a stabilization period during manual mode 32 for temperature adjustments to take effect. After a predetermined amount of ignition failures, the delay lockout period would prevent forced air heater 10 from restarting for a predetermined amount of time to allow any unburned fuel to escape combustion chamber 44 and to allow combustion chamber 44 to cool for a predetermined amount of time.

Each interface in communication with the controller 62 may be the interface that could comprise the user interface 30 in whole or in part. One such interface is an On/Stop button 34 to turn on and off the heater 10. Further another user interface 30 is the Mode/Reset button 35 that can cycle between the thermostat mode 33 and manual mode 32 as well as reset the heater. The actuation of buttons or user interfaces by the user may cause voltage change received at controller 62 (e.g., 0, +5V). Appropriately as shown in FIG. 3, indicator lights of LEDS 32*a*, 33*a*, and 37*a* correspond to each mode status; manual, thermostat, and standby, respectively, and may illuminate from the control panel 64. Although this user interface 30 is not shown, a pump pressure adjustment relief valve may be used to increase and decrease pump pressure. Also, an increase/decrease or adjustment user interface button 36 may be included to raise or lower the BTU output while in the manual mode 32 as well as changing the set point temperature of the thermostat in the thermostat mode 33. In use, button 36 is adjustable by a user in the field to select a particular heat output level such as in the manual mode 32. By selecting an increase or decrease on the panel button 36, the operator could determine the status of a voltage signal indicative of the selected heat output level. Controller 62 could receive the signal and send an appropriate signal to the indicator element 20 to achieve the pre-start alert before heated airflow exits the outlet 14 of the heater housing 50. Likewise, the button 36 could be utilized to select a temperature or temperature range, such as a set point for a thermostat mode 33 so that controller 62 could maintain and operate the indicator element 20 before imminent heat production. As previously mentioned, an information display 31 may be in electrical communication with controller 62. Preferably the information display 31 is a digital display, such as, but not limited to, an LCD screen or an array of Light Emitting Diodes (LEDS). However, the information display 31 could also consist, in whole or in part, of one or more analog displays, such as a dial indicator. The information display 31 could display a plethora of information, such as current heater mode, ambient temperature, desired temperature, heat output level, diagnostic information, pre-start indicator elements as described herein, or any other information garnered directly or indirectly from sensor elements 66, user interfaces 30, and heater components 16.

In use to start the portable heater 10 according to one embodiment, the user pushes the On/Stop button 34 to ON after the portable heater 10 has power. While being in manual mode 32, the one or more indicator elements 20 including the audible and visual indicator elements 24 and 22, respectively, will sound and display a start countdown to ignition. However, it is understood that another portable heater embodiment may have only one of the audible or visual indicator elements 20 instead of using both as is shown. Upon the lapse of the predetermined time period, approximately 8 seconds, the portable heater 10 will start and the pump pressure will be displayed for approximately six seconds on display 31. The pump pressure 38*a* indicator light will also be illuminating during the six second display. With the manual mode LED 32*a* on, the user may adjust the desired setting on the display 31 by pressing the increase adjustment button 36*a* to raise the BTU output or press the decrease adjustment button 36*b* to lower the BTU output. Further upon startup, the heater BTU output can be adjusted, but the adjustments may not take effect for a time period of approximately two minutes in order to allow for heater stabilization. Alternatively when the thermostat mode LED 33*a* is on, the user may change the thermostat set point temperature on the display 31 higher by pressing the increase adjustment button 36*a* and lower the set point by pressing the decrease adjustment button 36*b*. If the thermostat set temperature is higher than the surrounding air temperature, more specifically by three degrees, the heater will ignite after the pre-start indicator elements 20 alert of the imminent start of heat production as described above in the manual mode. However, if the thermostat set point is lower than the surrounding air temperature, the heater will not ignite. Heater output will adjust automatically to maintain the set temperature in the thermostat mode 33. As such, each automatic heater start that occurs over a time period, dependent on the thermostat, may include the pre-start indicator elements 20 to alarm and call attention to the bystanders and/or users before the imminent heat production or ignition. Further, when operating in the thermostat mode 33, the user may press the Mode/Reset button 35 once to change to manual mode 32. Also, when operating in the manual mode 32, the user may press the Mode/Reset button 35 twice within five seconds to change to the thermostat mode 33. Also, the display 31 not only shows the visual indicator element 22 but may show the set temperatures, surrounding temperatures, pressure, and BTU output temperatures when the user is adjusting the inputs of the user interfaces 30 or checking the status of these conditions.

Moving now to the flow chart of FIG. 2, one embodiment of the method of warning of the imminent start of heat production of a portable heater 10, in whole or in part, is illustrated in the flow chart. Further, FIG. 2 is a flow chart illustrating an example method of emitting an attention identifier indicative of the imminent start of heated airflow from the portable heater. Other implementations may perform the steps in a different order, omit certain steps, and/or perform different and/or additional steps than those illustrated in FIG. 2. For convenience, aspects of FIG. 2 will be described with reference to a system of one or more controllers 62 that performs the process or transmits the start signal to the indicator elements. The controller 62 may receive one or more inputs indicative of the sensor elements 66, user interface 30, and other heater components 16 to implement the pre-start indicator elements 20 output or attention identifiers to sufficiently alert the bystanders and users of the imminent heat production, or more basically that the heater is on and will soon begin to heat the environment. In block 2, the heater is started or turned on. As shown in block 4, the mode of the portable heater is confirmed to be in the manual mode 32 or thermostat mode 33. For example, controller 62 may receive input for determining or the status based on the mode. The igniter 84 operation, block 4*e*, begins after the operation mode is detected or selected. Countdown and buzzer begin after the igniter is energized. For example, controller 62 may provide output or signal to operate the igniter. If the heater is in the manual mode 32, block 4*a*, the attention identifiers will sound and the display will start the countdown via the pre-start indicator elements 20 in block 5. As such, manual mode may be described as independent of the set point and thermostat inputs. For example, controller 62 may operate the indicator elements. Again, the attention identifiers or alarm output of the pre-start indicator elements 20 may be of an audible indicator element 22 and/or visual indicator element 24 that operates for a predetermined time period. If the heater is in the thermostat mode 33 or selected, block 4*b*, the controller 62 may compare the ambient value or adjusted ambient value to the user interface set point. If the surrounding air temperature plus 3 degrees (adjusted ambient value) is less than the inputted set point temperature as shown in block 4*c*, the igniter is turned on as in block 4*e*. As such, the heater will ignite upon the pre-start indicator elements 20 alerting or emitting an attention identifier of the imminent start of heat production as described above in block 5. If the surrounding air temperature plus 3 degrees (adjusted ambient temperature) is greater than the thermostat set point, no action is taken and the heater will not ignite and remains off as shown in block 4*d*. As such when conditions are subsequently met within block 4*c* to automatically startup the heater, the emitting of the attention identifiers indicating the imminent start of heat production as in block 5 will commence. Also, if the time period of the indicator element output is interrupted by another action or key push, block 6, and the On/Off key is detected, block 6*a*, the heater may enter the On/Standby Routine, block 6*b*. As a result another action, block 6*c*, may occur such as a return indirectly or directly to block 4 of the flow chart of FIG. 2. Otherwise, the controller 62 will determine function of the detected keys performed, block 6*d*, and the time elapse will be uninterrupted. As a result, if the ignition time period does not elapse, block 7, the controller 62 may return to block 4*e*. Alternatively, upon completion of the time period of the alarm output of the indicator elements 20, block 7, the controller 62 will proceed with starting to heat the air by the heater and/or motor, block 8. Thus, the attention identifiers provide an alert before heat production or ignition in both the thermostat and manual modes.

Further, although the one or more indicator elements 20 are described and shown as emitting a attention identifier to alert individuals of the imminent start of heat production from a portable heater, it merely represents one embodiment, and it is to be understood that the indicator elements may alert or produce the attention identifier for a variety of other portable heater conditions. For example, fault or abnormal portable heater conditions may be desired to be communicated to the operator or bystanders. Fault conditions or abnormal heater conditions may be, but are not limited to, events such as when the motor does not start after the heater is plugged in and the on/stop button is on, motor starts and runs but heater does not ignite, heater ignites but control assembly shuts heater off before running out of fuel, high or low voltage, high or low pressure, high or low temperature, improper electrical connection, no ignition, improper or extinguished flame, high or low fuel, user interfaces are stuck, and other general problems that may occur when the heater is running or not running. For example in use while normally the operator could believe a stopped heater may be in a thermostat mode awaiting the automatic start of the heater, an audible attention identifier as described above may alert the operator that the heater has actually shut down for an unexpected problem or abnormal condition, such as no fuel. As a result, the operator may be advantageously alerted of the abnormal condition and remedy the condition. Alternatively, the indicator elements and its attention identifiers may alert or communicate desirable or normal portable heater data or conditions to the operator while the heater is running or not running.

It is understood that while certain embodiments of the invention have been illustrated and described, it is not limited thereto except insofar as such limitations are included in the following claims and allowable functional equivalents thereof.

We claim:

1. A portable heater comprising:

an elongated heater housing having an inlet end and an outlet end;

a fan positioned within said heater housing and forcing a heated airflow from said inlet end to said outlet end of said housing;

a fuel source within said housing downstream of said fan;

a combustion chamber in fluid communication with said fuel source and positioned within said housing; and one or more pre-start indicator elements indicating the imminent start of said heated airflow, wherein said one or more pre-start indicator elements operate for a predetermined time period before said heated airflow exits said outlet end of said heater housing, wherein said one or more pre-start indicator elements emit an attention identifier for said predetermined time period.

2. The portable heater of claim 1 wherein said one or more pre-start indicator elements is an optical emitter.

3. The portable heater of claim 1 wherein said one or more pre-start indicator elements is an audible alarm.

4. The portable heater of claim 1 wherein said one or more pre-start indicator elements is both an audible alarm and optical emitter.

5. The portable heater of claim 1 wherein the operation of said one or more pre-start indicator elements respond to a start signal transmitted from a controller in communication with said one or more pre-start indicator elements.

6. The portable heater of claim 5 wherein said controller determines said start signal based on one or more inputs received via a sensor element, a user interface, or combinations thereof indicative of imminent heat emission.

7. The portable heater of claim 6 wherein said sensor element is a thermostat.

8. The portable heater of claim 1 wherein said one or more pre-start indicator elements operate when said portable heater is on.

* * * * *